US007080485B2

(12) United States Patent
Cittadini

(10) Patent No.: US 7,080,485 B2
(45) Date of Patent: Jul. 25, 2006

(54) GASKET FOR REFRIGERATOR FURNITURE UNITS

(75) Inventor: Paolo Cittadini, Luvinate (IT)

(73) Assignee: Industrie Ilpea S.p.A., Malgesso (IT)

( * ) Notice: Subject to any disclaimer, the term of this patent is extended or adjusted under 35 U.S.C. 154(b) by 0 days.

(21) Appl. No.: 10/467,090

(22) PCT Filed: Jan. 23, 2002

(86) PCT No.: PCT/EP02/00669

§ 371 (c)(1),
(2), (4) Date: Nov. 17, 2003

(87) PCT Pub. No.: WO02/063227

PCT Pub. Date: Aug. 15, 2002

(65) Prior Publication Data

US 2004/0139661 A1 Jul. 22, 2004

(30) Foreign Application Priority Data

Feb. 2, 2001 (IT) ..... MI2001A0201

(51) Int. Cl.
*E06B 7/16* (2006.01)

(52) U.S. Cl. ..... 49/478.1; 49/489.1; 49/490.1; 49/498.1

(58) Field of Classification Search ..... 49/478.1, 49/489.1, 490.1, 492.1, 498.1
See application file for complete search history.

(56) References Cited

U.S. PATENT DOCUMENTS 2,700,194 A 1/1955 Rasmussen
3,226,367 A * 12/1965 Monti ..... 49/478.1
4,441,301 A * 4/1984 Benson ..... 52/784.13
4,469,383 A * 9/1984 Losert ..... 312/296
4,653,819 A * 3/1987 Swerbinsky ..... 312/296
4,829,652 A 5/1989 Haas et al.
5,018,264 A 5/1991 Kautt
5,060,358 A 10/1991 Haas et al.
5,588,731 A * 12/1996 Schmidt et al. ..... 312/405

(Continued)

FOREIGN PATENT DOCUMENTS

DE 3022381 12/1981

(Continued)

OTHER PUBLICATIONS

International Search Report mailed May 29, 2002 PCT/EP02/00669.

(Continued)

*Primary Examiner*—Gregory J. Strimbu
(74) *Attorney, Agent, or Firm*—Ablman, Frayne & Schwab

(57) ABSTRACT

A gasket for forming a seal between an outer door member and an inner door member, as well as a cabinet of a refrigeration unit. The gasket is adapted to seal the inner door edge of the inner door member to the outer door member, as well as between the outer door member and the cabinet. The gasket includes a semi-rigid profile portion joined to a bellows seal portion. The profile includes a base with a substantially C-shaped cross-section having upper and lower sections and a vertical or oblique section therebetween. An elbow piece formed at the lower section acts as a hinge for allowing elastic splaying of the lower section to snap-engage the edge of the inner door member. The lower section includes a projection that interfaces with an entire perimeter of the inner door member and that is directed toward the upper section to engage with a corresponding grooved seat formed on the inner door member. The bellows portion forms a seal with the cabinet.

17 Claims, 2 Drawing Sheets

U.S. PATENT DOCUMENTS 5,606,828 A 3/1997 Hall et al.
6,804,915 B1 * 10/2004 Holmqvist ..... 49/492.1

FOREIGN PATENT DOCUMENTS

DE EP 0 690 197 1/1996
EP 0 062 153 10/1982
EP 0 146 994 7/1985
EP 0 152 123 A 8/1985
EP 0 152 989 8/1985
EP 0 319 087 6/1989
EP 0 905 464 3/1999
EP 0 959 312 A 11/1999

OTHER PUBLICATIONS

International Preliminary Examination Report completed May 8, 2003 PCT/EP02/00669.

* cited by examiner

GASKET FOR REFRIGERATOR FURNITURE UNITS

BACKGROUND OF THE INVENTION (1) Field of the Invention

The present invention relates to gaskets for a refrigerator furniture unit and the like, and more specifically to a gasket for providing a seal between an outer door, inner door; and cabinet of the refrigerator furniture unit.

(2) Description of Related Art

The patent application EP 905464 in the name of the same Applicant describes a plastic gasket for refrigerator furniture units and the like provided with door and an inner door, having a bellows seal portion which forms a sealed closure between the door and the furniture, the profile and the seal portion being joined together or integral as a single piece produced by means of coextrusion of two materials having a different rigidity so as to allow, if necessary, easy separation of the seal portion from the profile along their joining zone, said profile having a groove able to receive a replacement bellows seal portion, said groove being defined by a pair of walls which extend vertically or obliquely from a base formed with a substantially C-shaped cross-section comprising two horizontal upper and lower sections and being elastically deformable as a result of an elbow piece made of soft material and formed by means of coextrusion on the cross-section itself, this elbow piece therefore acting as a hinge so as to allow elastic splaying of said C-shaped cross-section so as to receive by means of snap-engagement the edge of said inner door inside the cross-section itself.

For the purposes of installation, the profile with the coextruded seal is advantageously provided in the form of a rectangular frame welded at the corners and then assembled together with inner door and door, as is for example described also in the European patents Nos. 146,994 and 319,087 in the name of the same Applicant.

More particularly, according to the patent application EP 905464, the profile with the seal is welded so as to form a rectangular frame which may thus be mounted on an inner door of the same shape, generally with perimetral dimensions 0.5–3 mm smaller than the internal dimension delimited by the vertical section of the base of the profile.

This assembly is made possible by means of shearing of the lower horizontal section of said base, performed automatically during extrusion (or by acting on the end part of the ready-cut portions) to a depth of 3–5 mm and over the whole of its extension, thereby making it possible to avoid welding in the corners of this section. Each section therefore is excluded from welding and can therefore be splayed independently, by means of its hinging point, through angles even greater than 90° so as to allow insertion of the inner door.

The operation of splaying of the abovementioned section is generally performed manually by acting on the lower section of all four sides of the frame through an angle sufficient for positioning of the inner door. Once this operation has been performed, the sections are released and the hinge causes them to snap-engage back into their initial position, locking the inner door in the C-shaped cross-section of the base of the profile.

The profile and the inner door thus assembled are then placed on the door and the whole assembly is fixed by introducing foam into the cavity between door and inner door.

EP-A-0152989 and DE 3022381 describe seals extending around the periphery of a door for refrigerators, comprising a resiliently flexible sealing portion and a lip made of a stiffer material.

According to the objects of the present invention, it is desirable that a profile of the type described above should be in particular suitable for automated assembly, without manual operations which slow down production considerably and obviously increase costs. However, with regard to the use of automated systems, it must be remembered that the profile, when it is inserted into the inner door, form together with the latter an assembled system which must be able to withstand handling, including any sudden stresses imparted by the machinery, without causing any mutual displacement of profile and inner door.

SUMMARY OF THE INVENTION

The present invention relates to a gasket of the kind described above, in particular suitable on the one hand for assembly on the inner door in an automated manner an on the other hand for solving the technical problem which rises in connection with the automated handling of the assembled parts, whereby mutual displacement of the said parts must be avoided at all costs. This refers in particular to the moment when inner door and gasket in the form of a welded frame, once assembled, are gripped by suitable means, for example a suction pad which acts on the inner door, and are thus transported from the assembly station to the mould for filling the door/inner door system with foam. Since the foaming operation, namely filling of the cavity between door and inner door with a heat-insulating material such as polyurethane foam, would 'freeze' any defective positioning of the parts without the possibility for correction, any such defects must be carefully avoided so that correct fixing of gasket and inner door during transportation to the foaming mould is not disturbed even in the case of sudden movements which may be imparted to the assembled parts by the system performing transportation from one station to another, and rapid, precise and safe operation is possible only when it is ensured that said parts remain in a fixed position, without mutual displacement.

The present invention proposes an improved gasket of the abovementioned kind, suitable in particular for the solution of the technical problem described above. It consists of a plastic profile for refrigerator furniture units and the like provided with door and an inner door, having a bellows seal portion which forms a sealed closure between the door and the furniture, the profile and the seal portion being joined together or integral as a single piece produced by means of coextrusion of two materials having a different rigidity, said profile having a base formed with a substantially C-shaped cross-section comprising two horizontal upper and lower sections and being elastically deformable as a result of an elbow piece made of soft material and formed by means of coextrusion on the cross-section itself, this elbow piece therefore acting as a hinge for allowing elastic splaying of said C-shaped cross-section so as to receive by means of snap-engagement the edge of said inner door inside the cross-section itself, and externally and underneath said C-shaped cross-section the profile forming a seal on the edge of said door, characterized in that said lower section of said base is formed with a projection directed towards said upper section and able to engage operationally with a corresponding grooved seat formed on said inner door.

BRIEF DESCRIPTION OF THE DRAWINGS

So that characteristic features and advantages of the invention may be better understood, a non-limiting example of embodiment thereof is described with reference to the figures of the accompanying drawings.

DETAILED DESCRIPTION OF THE INVENTION

Figure 1:
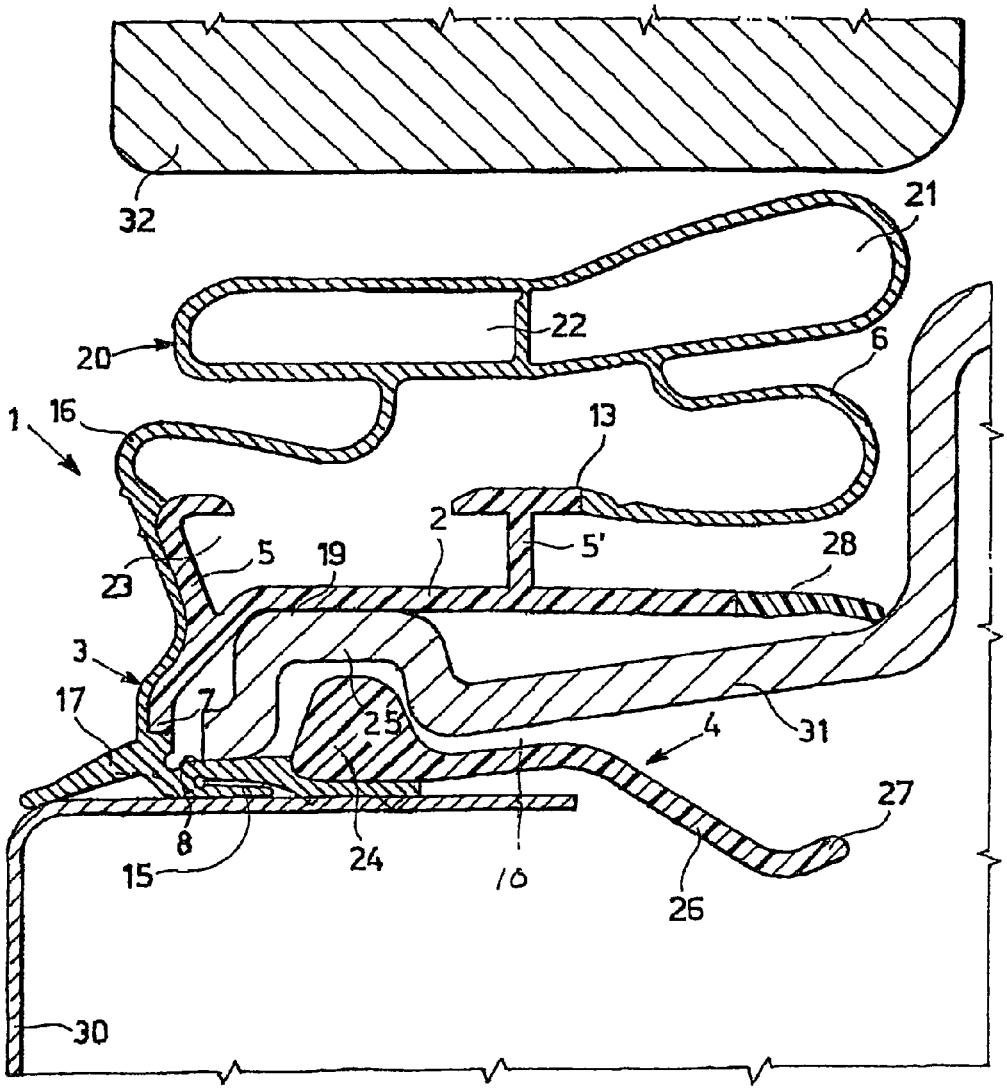
FIG. 1 shows a cross-sectional view of a gasket according to the invention in an operative position.

With reference to the drawing in FIG. 1, a plastic gasket 1 for refrigerator furniture units provided with door 30 and inner door 31 consists of a profile made of substantially rigid plastic, and shown by the thicker hatching, and a bellows seal portion 20 which forms a sealed closure between door and the furniture 32 of the refrigerator.

The profile and the seal portion 20 are joined together or integral as a single piece produced by means of coextrusion of two materials having a different rigidity so as to allow, if necessary, easy separation of the seal portion from the profile along their joining zone. This profile made of rigid material defines centrally a groove 23 able to receive a replacement bellows seal portion, this groove 23 being defined by a pair of walls 5, 5' which extend vertically and obliquely from a base denoted overall by 3. According to the invention this base 3 is essentially formed with a C-shaped cross-section defined by two horizontal sections 2 and 4, i.e. an upper section and a lower section respectively, and a substantially vertical section 7 inside which a seat 19 is defined. Said vertical section 7 and said lower horizontal section 4 are joined together by an elbow-piece 8 made of soft material and formed by means of coextrusion on the cross-section itself with the rigid material which forms the base 3 of the profile, this elbow piece 8 acting as a hinging point for allowing elastic splaying of said C-shaped cross-section, in particular of the lower horizontal section 4 with respect to the sections 2 and 7.

The profile of the gasket 1 is made of rigid plastic, for example PVC obtained by means of extrusion, cut and welded at the corners in the form of a frame which reproduces the perimeter of the door of the refrigerator furniture unit to which it is applied. As already mentioned, a seal 20, for example consisting of soft plasticized PVC, is also formed with the profile by means of coextrusion as a single piece.

The seal 20 has a tubular section which defines an extendable chamber 21 acting as a bellows from where a seat 22 able to receive a bar of magnetic material extends. The internal side part, denoted by 6, of the seal 20 is welded to the corresponding wall 5' of the profile at the coextrusion point 13, while the external side wall, denoted by 16, is integrally welded to the corresponding external wall 5 of the profile and along the outer side of the base 3.

The bottom shaped part of the external side wall 16 of the seal (wall which may be suitably varied in two zones having a different thickness or rigidity for ensuring the lateral stability thereof) covers fully the profile, terminating at the bottom in the said elbow-piece 8 defined above. A pair of sealing strips 15 and 17 also made of soft material extend laterally from the latter towards the outside of the profile, said strips resting in a compressed manner owing to the deformability of this material on the door 30 when the parts are assembled in the operative position, so as to form a seal and moreover ensure that the rigid portion of the gasket 1 is fully concealed in this position.

In particular, these sealing strips constitute a seal for containing the foaming material which is used at the end in order to provide the door with heat-insulating properties after assembly of the parts. The strip 17 forms a seal with the metal plate of the door independently of its shape, since it is able to come into sealing abutment against it.

The upper section 2 of the base 3 of the profile also has a strip of coextruded soft material 28 able to form a seal against the inner door in the final operative position.

According to the present invention, the lower section 4 of the base 3 is formed in the manner of a projection 24 directed towards the upper section 2 and able to engage operationally with a grooved seat 25 having a matching shape (in particular U shape) formed on the inner door 31 in the region of the edge of the latter. In order to be able to receive the edge of the inner door formed with this U-shaped groove, the interspace 10 in the C-shaped cross-section of the base 3 must be sufficiently wide and for this purpose the substantially vertical section 7 is at least partly directed obliquely.

In the example shown in the Figure, this projection 24 is formed at the end of the section 4 of the rigid base of the profile which is located close to the soft elbow piece 8, while at the opposite end the section 4 is formed with a section obliquely inclined downwards 26 and finally with an edge 27 directed back upwards.

For the purposes of installation, the gasket 1 with the coextruded seal 20 is advantageously provided in the form of a rectangular frame which is welded at the corners and may thus be mounted on an inner door having the same shape in general with perimetral dimensions 0.5–3 mm smaller than the inner dimension delimited by the vertical section 7 of the base 3. This assembly is made possible by means of shearing of the horizontal section 4, performed automatically during extrusion (or by acting on the end part of the ready-cut portions) to a depth of 3–5 mm and over the whole of its extension, thereby making it possible to avoid welding in the corners of this section.

Figure 2:
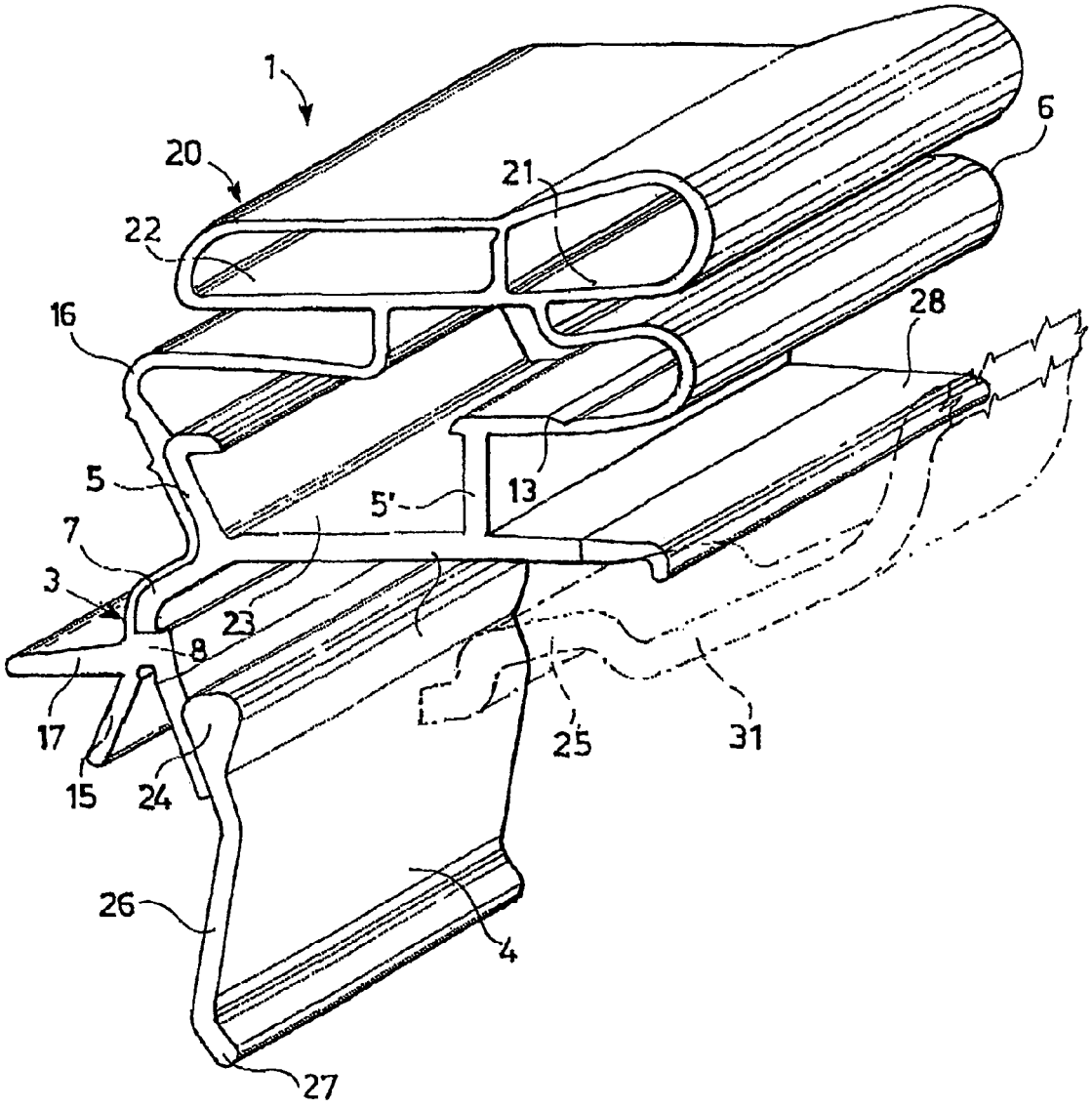
FIG. 2 shows a perspective view of a portion of the gasket according to the invention during assembly on the inner door.

Each section 4 is therefore excluded from welding and can therefore be splayed independently and easily downwards, by means of the hinging point 8, through angles greater than 90° so as to allow insertion of the inner door 31, as shown in FIG. 2. The profile along the zone of welding (shown in view) with another portion of the profile is suitable for welding at any point, excluding the section 4 previously cut along 10. The edge of the inner door 31 may be advantageously prestressed in an elastic manner.

In a patent application filed simultaneously by the same applicant, a method and an apparatus able to perform in an automated manner the abovementioned assembly operations are described.

The operation of splaying of the section is performed with the aid of a machine provided with an automatic system (such as that described in the abovementioned simultaneous patent application in the name of the same applicant) which splays the lower section 4 on all four sides of the frame at an angle which is sufficient for positioning of the inner door, as schematically shown in FIG. 2. The above-described shaping of the section 4 in the oblique direction 26 and the end 27 facilitates engagement of the said splayable section by means envisaged for this purpose in the automatic apparatus. Once this operation has been performed, the sections 4 are released and the hinge 8 brings them back by means of snap-engagement into the position shown in FIG.

1, locking the inner door between the section 4 and the section 2 of the base of the profile. During its elastic return movement, the projection 24 of the section 4 is inserted by means of snap-engagement into the grooved seat 25 on the edge of the inner door. The projection 24 and the grooved seat 25 therefore constitute first and foremost a centring system during mutual positioning for assembly of profile and inner door.

In this position, shown in solid lines in FIG. 1, the lower sections 4 of the profile elastically act against the prestressed edge of the inner door 31. The engagement between the projection 24 on the profile and the corresponding grooved seat 25 formed on the inner door also ensures fixing of its parts along the whole perimeter of the inner door such as to ensure a stable connection, without the risk of mutual displacement even in the case of sudden stresses which may be imparted by the machinery.

The gasket 1 and the inner door 31 thus assembled are then placed on the door 30 (for example by means of a robot system) and the assembly is fixed by filling the cavity between door and inner door with foam. In this final operative position, the profile forms a seal on the edge of the door 30 in the region of the sealing strips 15 and 17 and therefore underneath and externally with respect to said C-shaped cross-section.

The profile, when it is inserted on the inner door, forms therewith a single assembly which may be safely transported, being able to withstand also any sudden movements without causing separation, as a result of the interference between grooved seat 25 and projection 24.

A further advantage of the invention is that the interference between profile and inner door in the region of the coupling between projection 24 and seat 25 allows an additional sealing action preventing any foam from passing outside the door during the foam-filling stage.

Moreover the walls 5 and 5' of the profile, which allow the engagement of a replacement seal if necessary, during the foam-filling operation limit compression of the profile and therefore allow a very small degree of deformation of the soft wall to be achieved.

The soft material coextruded on the outside of the profile avoids possible differences in colour between the rigid material and the soft material, and the substantially rigid structure of the profile prevents the profile itself-flexing over partially on the horizontal sides owing to the weight of the magnetic insert.

The invention claimed is:

1. A gasket (1) for providing a seal between a refrigerator furniture unit and a refrigerator door formed by an outer door member (30) and an inner door member (31), and a second seal between the outer door member (30) and the inner door member (31), said gasket comprising:

a profile made of a substantially rigid plastic and having a bellows seal portion (20), which is made of a substantially soft plastic relative to said profile and adapted to form the seal between the outer door member and the furniture unit (32), the profile and the bellows seal portion being joined together as a single piece, said profile including a base (3) formed with a substantially C-shaped cross-section defined by two substantially horizontal sections, one upper (2) and one lower (4), and by one of a vertical section and an oblique section (7), said vertical or oblique section (7) including an elastically deformable elbow piece (8), which is made of a soft material relative to said profile and formed by coextrusion with the base (3) and the lower horizontal section (4) of the C-shaped cross-section, the elbow piece (8) forming a hinge for allowing elastic splaying of said lower horizontal section (4) with respect to the upper horizontal section (2) of said C-shaped cross-section, said C-shaped cross section for receiving by snap-engagement an edge of said inner door member (31) inside (19) the C-shaped cross-section, the gasket for forming the second seal between said outer door member (30) and the inner door member underneath said C-shaped cross-section, wherein said lower horizontal section (4) of said base (3) includes a projection (24) formed of said substantially rigid plastic for interfacing with an entire perimeter of said inner door member and extending towards said upper horizontal section (2) for engaging operationally with a corresponding grooved seat (25) formed on said inner door member (31) and for mutually positioning said profile with respect to said inner door member to facilitate automated assembly thereto, said lower horizontal section (4) having opposing first and second end portions, wherein the projection (24) is formed at the first end portion of the lower horizontal section (4) proximate the elbow piece (8), and the second end portion of the lower horizontal section (4) includes a mid-section (26) extending from the projection (24) obliquely downwards (26) away from said upper horizontal section and an edge portion (27) extending upwards towards said upper horizontal section (2), wherein said second end portion enables said elastic splaying of said lower horizontal section (4) automatically during assembly of said gasket to said inner door member (31).

2. The gasket according to claim 1, characterized in that said one of said vertical and oblique section (7) of the base (3) is partly directed vertically and partly obliquely.

3. The gasket according to claim 1, wherein the casket includes opposing ends that are welded together to form a frame.

4. The gasket according to claim 2, characterized in that said elbow piece (8) is formed integrally with said seal portion (20) which is superimposed externally on said profile and said base (3).

5. The gasket according to claim 4, wherein the gasket includes opposing ends that are welded together to form a frame.

6. The gasket according to claim 1, characterized in that a pair of sealing strips (15, 17) made of a soft material relative to said profile extend from said elbow piece (8) and in the operative position of the profile extend toward the outer door member.

7. The gasket according to claim 6, wherein the casket includes opposing ends that are welded together to form a frame.

8. The gasket according to claim 1, characterized in that said upper horizontal section (2) includes a pair of walls (5), said seal portion (20) is coextruded with said profile so as to be superimposed thereon over a length of an external one of said pair of walls and over said base (3).

9. The gasket according to claim 8, wherein the gasket includes opposing ends that are welded together to form a frame.

10. The gasket according to claim 1, characterized in that a sealing strip (28) made of a soft flexible material relative to said profile extends from said upper horizontal section (2) of said base (3).

11. The gasket according to claim 10, wherein the gasket includes opposing ends that are welded together to form a frame.

12. The gasket according to claim 1, wherein said profile includes opposing ends that are welded together to form a frame.

13. A door for refrigerators including an inner door member (31) and the gasket (1) according to claim 1.

14. A door for refrigerators including an inner door member (31) and the gasket (1) according to claim 2.

15. A door for refrigerators including an inner door member (31) and the gasket (1) according to claim 6.

16. A door for refrigerators including an inner door member (31) and the gasket (1) according to claim 4.

17. A door for refrigerators including an inner door member (31) and the gasket (1) according to claim 8.

* * * * *